US007481666B2

(12) United States Patent
Stein

(10) Patent No.: US 7,481,666 B2
(45) Date of Patent: Jan. 27, 2009

(54) INSULATION DISPLACEMENT TERMINAL CONNECTING DEVICE

(75) Inventor: Ulf Stein, Grasellenbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/001,440

(22) Filed: Dec. 11, 2007

(65) Prior Publication Data

US 2008/0146073 A1 Jun. 19, 2008

(30) Foreign Application Priority Data

Dec. 19, 2006 (EP) ..... 06026334

(51) Int. Cl.
*H01R 4/24* (2006.01)

(52) U.S. Cl. ..... 439/409

(58) Field of Classification Search ..... 439/409, 439/410

See application file for complete search history.

(56) References Cited

U.S. PATENT DOCUMENTS

| | | | | |
|---|---|---|---|---|
| 4,995,829 | A * | 2/1991 | Geib et al. | 439/409 |
| 5,785,548 | A | 7/1998 | Capper et al. | |
| 6,254,421 | B1 | 7/2001 | Denovich et al. | |
| 6,406,324 | B1 | 6/2002 | Duesterhoeft et al. | |
| 7,234,961 | B2 * | 6/2007 | Arlitt et al. | 439/410 |

* cited by examiner

*Primary Examiner*—Tho D Ta

(57) ABSTRACT

There is described an insulation displacement terminal connecting device with adjacent insulation displacement terminal connectors is created, its swivel joint levers forming a stepped separating plane. This allows an arrangement of the contact openings to be achieved with optimal space utilization, allowing a narrow structural form.

3 Claims, 2 Drawing Sheets

INSULATION DISPLACEMENT TERMINAL CONNECTING DEVICE

CROSS REFERENCE TO RELATED APPLICATIONS

This application claims priority of European Patent Office application No. 06026334.0 EP filed Dec. 19, 2006, which is incorporated by reference herein in its entirety.

FIELD OF INVENTION

The invention relates to an insulation displacement terminal connecting device with at least two adjacent insulation displacement terminal connectors, each having a swivel joint lever.

BACKGROUND OF INVENTION

An insulation displacement terminal connecting device of this type is disclosed for example in the patent U.S. Pat. No. 5,785,548. It comprises a number of insulation displacement terminal connectors, each having a swivel joint lever that can be pivoted between two positions. Two unstripped wires inserted into the swivel joint lever are brought into contact with fixed, blade-type connector units by pivoting the swivel joint lever, said blade-type connector units engaging in rear contact openings of the swivel joint lever, thereby splitting the wire insulation. A separating segment is located between each of the adjacent swivel joint levers shown here, which are housed in a common housing with the connector units. To save space, there are embodiments without said separating segment, in other words the swivel joint levers are disposed close to one another forming a planar separating plane.

Further correspondingly embodied insulation displacement terminal connecting devices can be found in the documents U.S. Pat. Nos. 6,254,421 and 6,406,324.

SUMMARY OF INVENTION

An object of the invention is to improve an insulation displacement terminal connecting device of the type mentioned above so that space is saved, allowing a narrow structural form, or more insulation displacement terminal connectors can be achieved with the same structural width.

The object is achieved in that a stepped separating plane is present between the swivel joint levers. The stepped separating plane between two or adjacent more swivel joint levers allows the grid spacing to be reduced significantly in an arrangement of two or more swivel joint levers.

If the step of the separating plane is embodied in a curved shape, the swivel joint lever can be pivoted and it is possible to prevent it jamming.

It is also advantageous that the swivel joint levers each have a contact opening, which extends into the angle region formed in each instance by the step.

BRIEF DESCRIPTION OF THE DRAWINGS

An exemplary embodiment of the invention is described in more detail below with reference to a drawing, in which.

DETAILED DESCRIPTION OF INVENTION

Figure 1:
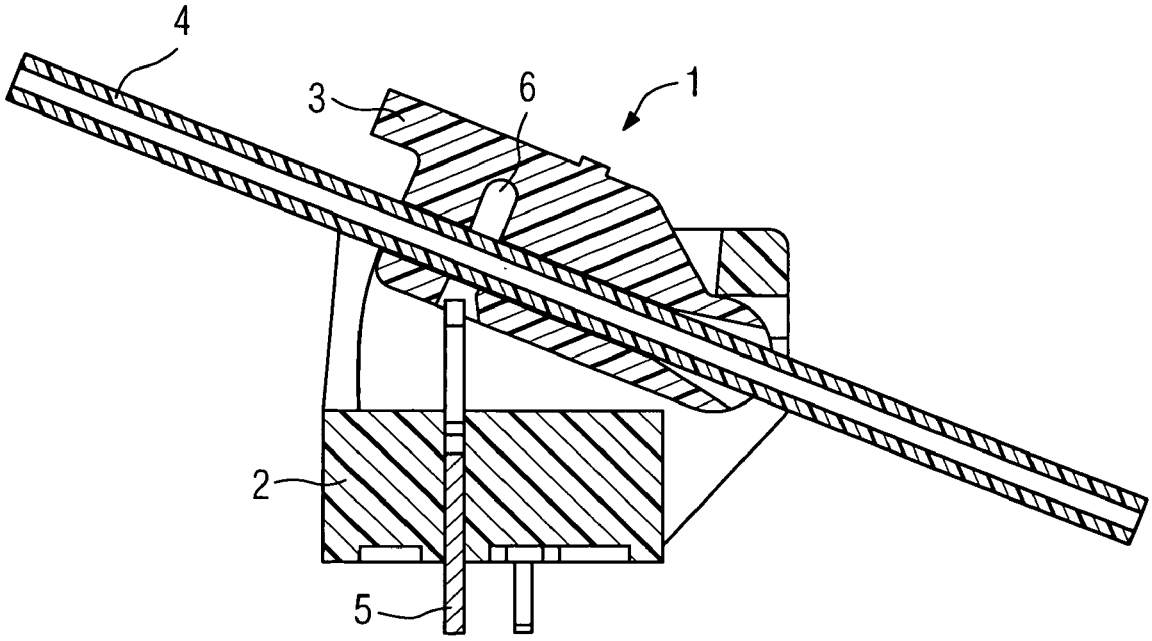
FIG. 1 shows a cross-sectional representation of an insulation displacement terminal connector according to the prior art.

FIG. 1 shows a cross-section of an insulation displacement terminal connector 1, which is essentially made up of a housing 2 and a swivel joint lever 3 that can be pivoted in relation to said housing 2. The purpose is to bring an unstripped wire 4 into contact with a blade-type connector unit 5 fixed in the housing 2. To this end the wire 4 in the upper position shown here is first inserted into the swivel joint lever 3. Pivoting the swivel joint lever 3 into the lower position causes the blade-type connector unit 5 to engage in a contact opening 6 located on the lower side of the swivel joint lever 3, with contact being achieved by splitting the wire insulation.

An insulation displacement terminal connecting device has a number of such insulation displacement terminal connectors. The swivel joint levers of adjacent insulation displacement terminal connectors are close to one another and form a planar separating plane according to the prior art.

Figure 2:
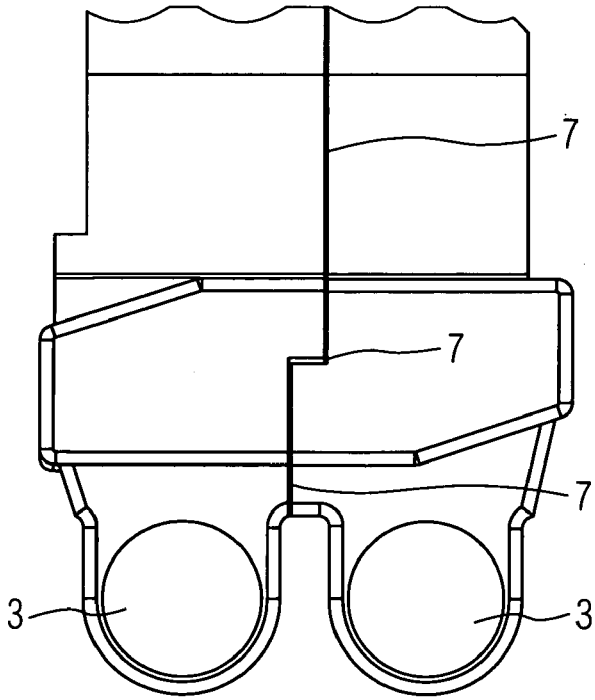
FIG. 2 shows a top view of two adjacent inventively embodied swivel joint levers of two insulation displacement terminal connectors.
Figure 3:
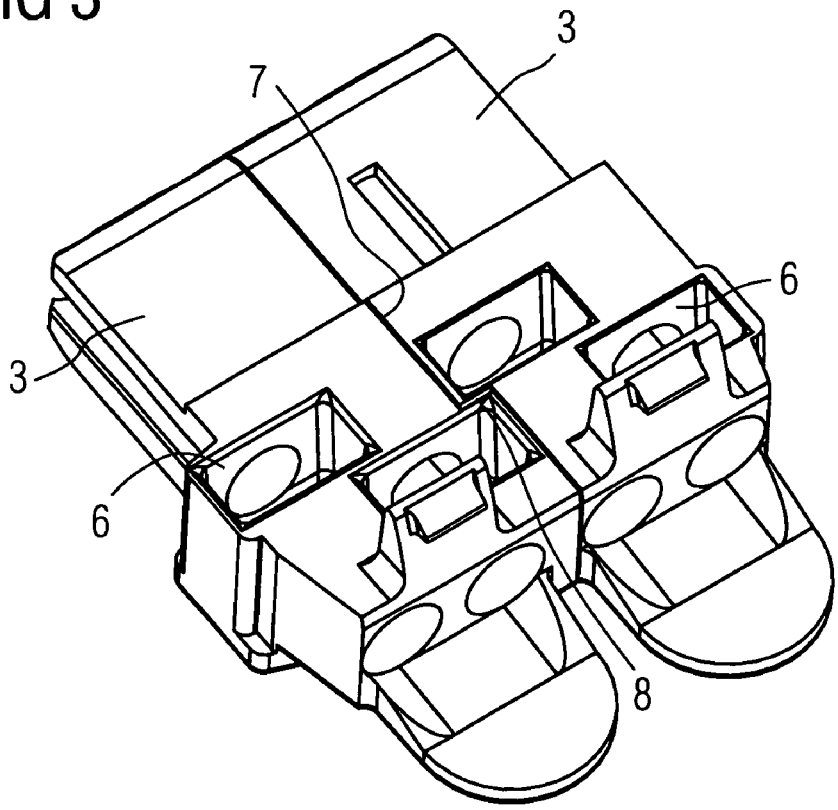
FIG. 3 shows a perspective rear view of the two inventive swivel joint levers according to FIG. 2
Figure 4:
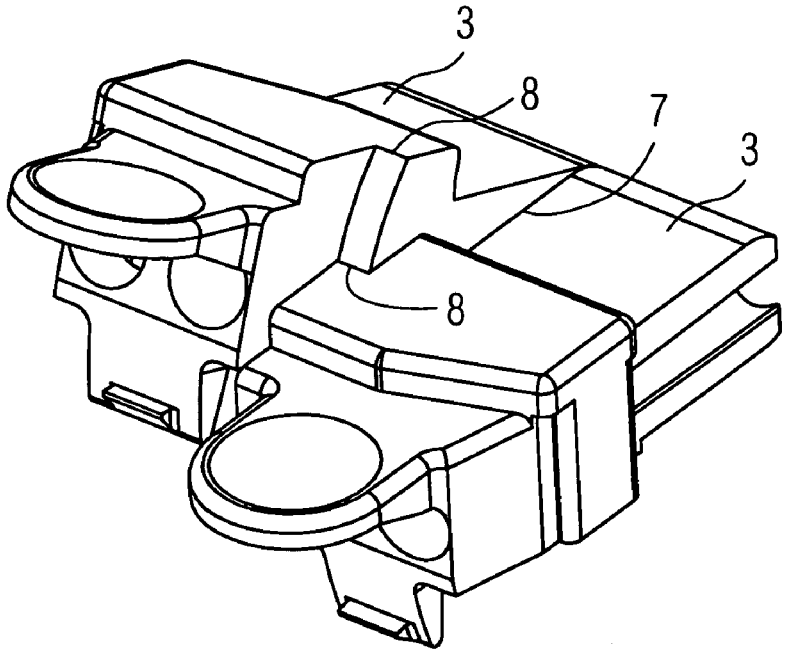
FIG. 4 shows a perspective front view of the inventive swivel joints levers according to FIGS. 2 and 3 pivoted toward one another.

According to the invention the separating plane is configured in a stepped manner, as shown in FIGS. 2, 3 and 4.

FIG. 2 shows a top view of two adjacent swivel joint levers 3 with a stepped separating plane 7.

It can be seen from the perspective rear view of two swivel joint levers 3 according to FIG. 3 that each swivel joint lever has two contact openings 6 disposed in an offset manner on its lower side. The step 8 in the separating plane 7 creates an angle region for each swivel joint lever 3, into which one of its two contact openings 6 extends. This means that there is an arrangement of the contact openings 6 with optimal space utilization on the separating plane 7 as well.

To allow the swivel joint levers 3 to pivot, the step 8 of the separating plane 7 is embodied in a curved shape, with the center of the curve corresponding to the center of rotation of the swivel joint lever 3. When the stepped separating plane is incorporated, minimum wall thicknesses should be observed and these are a function of the respective material parameters.

The invention claimed is:

1. An insulation displacement terminal connecting device, comprising:

at least two adjacent insulation displacement terminal connectors;

a swivel joint lever, wherein each of the at least two adjacent insulation displacement terminal connectors has a respective swivel joint lever, each swivel joint lever having at least one contact opening where insulation-displacement of a connector wire received in the at least one contact opening occurs in response to a swivel movement of the swivel joint lever; and a surface-offsetting structure that defines a stepped separating plane between the swivel joint levers, wherein the surface-offsetting structure is arranged so that the respective contact openings and corresponding connector wires in any two adjacent insulation displacement terminal connectors are positioned in two distinct non-coplanar surfaces relative to one another.

2. The insulation displacement terminal connecting device as claimed in claim 1, wherein the surface-offsetting structure has a curved step.

3. The insulation displacement terminal connecting device as claimed in claim 2, wherein the contact opening extends into an angle region formed by the step.

* * * * *